US011017703B2

(12) United States Patent
Ji et al.

(10) Patent No.: US 11,017,703 B2
(45) Date of Patent: May 25, 2021

(54) METHOD FOR MANUFACTURING DISPLAY DEVICE, METHOD FOR REPAIRING DISPLAY DEVICE, AND DISPLAY DEVICE

(71) Applicant: HKC CORPORATION LIMITED, Shenzhen (CN)

(72) Inventors: Feilin Ji, Chongqing (CN); Wei Chen, chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/042,910

(22) PCT Filed: Jan. 29, 2019

(86) PCT No.: PCT/CN2019/073616
§ 371 (c)(1),
(2) Date: Sep. 29, 2020

(87) PCT Pub. No.: WO2020/133632
PCT Pub. Date: Jul. 2, 2020

(65) Prior Publication Data

US 2021/0020086 A1 Jan. 21, 2021

(30) Foreign Application Priority Data

Dec. 25, 2018 (CN) ..... 201811587233.0

(51) Int. Cl.
*G09G 3/00* (2006.01)
*G09G 3/20* (2006.01)

(52) U.S. Cl.
CPC ..... *G09G 3/006* (2013.01); *G09G 3/20* (2013.01); *G09G 2330/08* (2013.01); *G09G 2330/12* (2013.01)

(58) Field of Classification Search
CPC ..... G09G 3/006; G09G 3/20; G09G 2330/08; G09G 2330/12; G02F 1/1309; G02F 1/13306; G02F 1/13458; G02F 1/136286
See application file for complete search history.

(56) References Cited

U.S. PATENT DOCUMENTS 9,286,847 B2 * 3/2016 Yu ..... G09G 3/20
2010/0201902 A1 * 8/2010 Hsu ..... G09G 3/3677 349/54

(Continued)

FOREIGN PATENT DOCUMENTS

CN 104008713 A 8/2014
CN 107945724 A 4/2018

OTHER PUBLICATIONS

Zijia Zhao, the ISA written comments, Sep. 2019, CN.
Zijia Zhao, the International Search Report, dated Sep. 2019, CN.

*Primary Examiner* — Christopher J Kohlman

(57) ABSTRACT

Disclosed are a method for manufacturing a display device, a method for repairing a display device, and a display device. The display device includes a display panel and a driver chip and the display panel includes: gate lines, and a first screen gate driver circuit and a second screen gate driver circuit that correspond to a same group of gate lines. Detecting whether the first screen gate driver circuit and the second screen gate driver circuit are normal; and when a detection result is "normal", connecting the first screen gate driver circuit and/or the second screen gate driver circuit to the driver chip; or when a detection result is "damaged", physically disconnecting the first screen gate driver circuit and/or the second screen gate driver circuit from the driver chip.

17 Claims, 10 Drawing Sheets

(56) References Cited

U.S. PATENT DOCUMENTS

| | | | | |
|---|---|---|---|---|
| 2011/0148825 | A1* | 6/2011 | Ueno | G09G 3/006 345/204 |
| 2012/0062528 | A1* | 3/2012 | Kimura | G09G 3/3688 345/204 |
| 2015/0187317 | A1* | 7/2015 | Seo | G09G 3/006 345/212 |
| 2016/0163264 | A1* | 6/2016 | Nishimura | H05B 33/08 345/212 |
| 2017/0123284 | A1 | 5/2017 | Lee et al. | |
| 2017/0139292 | A1* | 5/2017 | Yu | G02F 1/136286 |
| 2017/0308233 | A1* | 10/2017 | Katsuta | G06F 3/04166 |

* cited by examiner

METHOD FOR MANUFACTURING DISPLAY DEVICE, METHOD FOR REPAIRING DISPLAY DEVICE, AND DISPLAY DEVICE

This application claims the priority to Chinese Patent Application No. CN201811587233.0, filed with National Intellectual Property Administration, PRC on Dec. 25, 2018 and entitled "METHOD FOR MANUFACTURING DISPLAY DEVICE, METHOD FOR REPAIRING DISPLAY DEVICE, AND DISPLAY DEVICE", which is incorporated herein by reference in its entirety.

TECHNICAL FIELD

This application relates to the field of display technologies, and in particular, to a method for manufacturing a display device, a method for repairing a display device, and a display device.

BACKGROUND

Statement herein merely provides background information related to this application and does not necessarily constitute the existing technology.

With development and advancement of science and technologies, due to hot spots such as thinness, power saving, and low radiation, flat panel displays become mainstream products of displays and are widely applied. A flat panel display includes a Thin Film Transistor-Liquid Crystal Display (TFT-LCD), an Organic Light-Emitting Diode (OLED) display, and the like. The TFT-LCD controls rotating directions of liquid crystal molecules, to enable light in a backlight module to be refracted out to generate a picture, and the TFT-LCD has various advantages such as thin body, power saving, and no radiation.

In recent years, TFT-LCDs tend to have an increasingly large size, and most of them adopt a dual-side screen gate driver. The screen gate driver generally uses a GOA (Gate Driver on Array) structure, that is, a screen gate driver circuit is directly bound to an array substrate. However, for a display panel having a dual-side screen gate driver on array architecture, damage of a screen gate driver circuit at one side may affect a normal drive effect of a screen gate driver circuit at the other side. Consequently, a display panel in which a screen gate driver circuit at one side is damaged needs to be scrapped, seriously affecting the yield of display devices.

SUMMARY

This application provides a method for manufacturing a display device, a method for repairing a display device, and a display device, to make a display panel in which a screen gate driver circuit at one side is damaged be normally used, thereby improving a product yield.

To implement the foregoing objective, this application provides a method for manufacturing a display device, and the display device includes a display panel and a driver chip coupled to the display panel.

The display panel includes: gate lines; and a first screen gate driver circuit and a second screen gate driver circuit that correspond to a same group of gate lines. The manufacturing method includes: detecting whether the first screen gate driver circuit and the second screen gate driver circuit are normal; and when a detection result is "normal", connecting the first screen gate driver circuit and/or the second screen gate driver circuit to the driver chip; or when a detection result is "damaged", physically disconnecting the, first screen gate driver circuit and/or the second screen gate driver circuit from the driver chip.

This application further discloses a method for repairing a display device, and the display device includes a display panel and a driver chip coupled to the display panel.

The first screen gate driver circuit and a second screen gate driver circuit are separately provided at two sides of the display panel, the driver chip is physically connected to the first screen gate driver circuit and the second screen gate driver circuit, and one of the first screen gate driver circuit and the second screen gate driver circuit is damaged.

The repair method includes:

detecting whether the first screen gate driver circuit and the second screen gate driver circuit are normal; and when it is detected that the first screen gate driver circuit is damaged, physically disconnecting the driver chip from the first screen gate driver circuit; or when it is detected that the second screen gate driver circuit is damaged, physically disconnecting the driver chip from the second screen gate driver circuit.

This application further discloses a display device, including: a display panel; and a driver chip coupled to the display panel, where the display panel includes: gate lines; and a first screen gate driver circuit and a second screen gate driver circuit that correspond to a same group of gate lines. In the first screen gate driver circuit and the second screen gate driver circuit, at least one screen gate driver circuit is connected to the driver chip, and at least one screen gate driver circuit is physically disconnected from the driver chip.

Compared with a solution that in a manufacturing process of a display panel, the entire display panel or a display device is scrapped due to damage of a screen gate driver circuit caused by electrostatic stroke or another factor, in this application, after being, manufactured and before being correspondingly connected to the driver chip, the display panel is first detected, to detect whether the first screen gate driver circuit and the second screen gate driver circuit are normal. If the first screen gate driver circuit and/or the second screen gate driver circuit are abnormal, the first screen gate driver circuit and the second screen gate driver circuit of the display panel that is originally required to be scrapped are accurately tested, to find out a damaged screen gate driver circuit and a normal screen gate driver circuit, and the damaged screen gate driver circuit is physically disconnected from a corresponding signal cable, so that the normal screen gate driver circuit can receive a screen gate driver signal, and the damaged screen gate driver circuit does not receive a screen gate driver signal. In this case, the damaged screen gate driver circuit is not connected to the normal screen gate driver circuit, and does not affect the drive signal received by the normal screen gate driver circuit, and the normal screen gate driver circuit can individually drive the display panel to operate normally, thereby avoiding scrapping of the display panel and improving the yield of display devices.

BRIEF DESCRIPTION OF DRAWINGS

The drawings included are used for providing specific understanding of embodiments of this application, constitute part of the specification, and are used for illustrating implementations of this application, and interpreting principles of this application together with text description. Apparently, the accompanying drawings in the following descriptions are merely some embodiments of this application, and a person of ordinary skill in the art can also obtain other accompanying drawings according to these accompanying drawings without involving any creative effort. In the accompanying drawings.

DETAILED DESCRIPTION OF EMBODIMENTS

Specific structures and functional details disclosed herein are merely representative, and are intended to describe the objectives of the exemplary embodiments of this application. However, this application may be specifically implemented in many alternative forms, and should not be construed as being limited to the embodiments set forth herein.

In the description of this application, it should be understood that orientation or position relationships indicated by the terms such as "center", "transverse", "on", "below", "left", "right", "vertical", "horizontal", "top", "bottom", "inside", and "outside" are based on orientation or position relationships shown in the accompanying drawings, and are used only for ease and brevity of illustration and description, rather than indicating or implying that the mentioned apparatus or component must have a particular orientation or must be constructed and operated in a particular orientation. Therefore, such terms should not be construed as limiting of this application. In addition, the terms such as "first" and "second" are used only for the purpose of description, and should not be understood as indicating or implying the relative importance or implicitly specifying the number of the indicated technical features. Therefore, a feature defined by "first" or "second" can explicitly or implicitly includes one or more of said features. In the description of this application, unless otherwise stated, "a plurality of" means two or more than two. In addition, the terms "include", "comprise" and any variant thereof are intended to cover non-exclusive inclusion.

In the description of this application, it should be noted that, the terms such as "mount", "install", "connect", and "connection" should be understood in a broad sense. For example, the connection may be a fixed connection, a detachable connection, or an integral connection; or the connection may be a mechanical connection or an electrical connection: or the connection may be a direct connection, an indirect connection through an intermediary, or internal communication between two components. A person of ordinary skill in the art may understand the specific meanings of the foregoing terms in this application according to specific situations.

The terminology used herein is for the purpose of describing specific embodiments only and is not intended to be limiting of exemplary embodiments. As used herein, the singular forms "a", "an" and "the" are intended to include the plural forms as well, unless the context clearly indicates otherwise. It should be further understood that the terms "include" and/or "comprise" when used in this specification, specify the presence of stated features, integers, steps, operations, units, and/or components, but do not preclude the presence or addition of one or more other features, integers, steps, operations, units, components, and/or combinations thereof.

Figure 1:
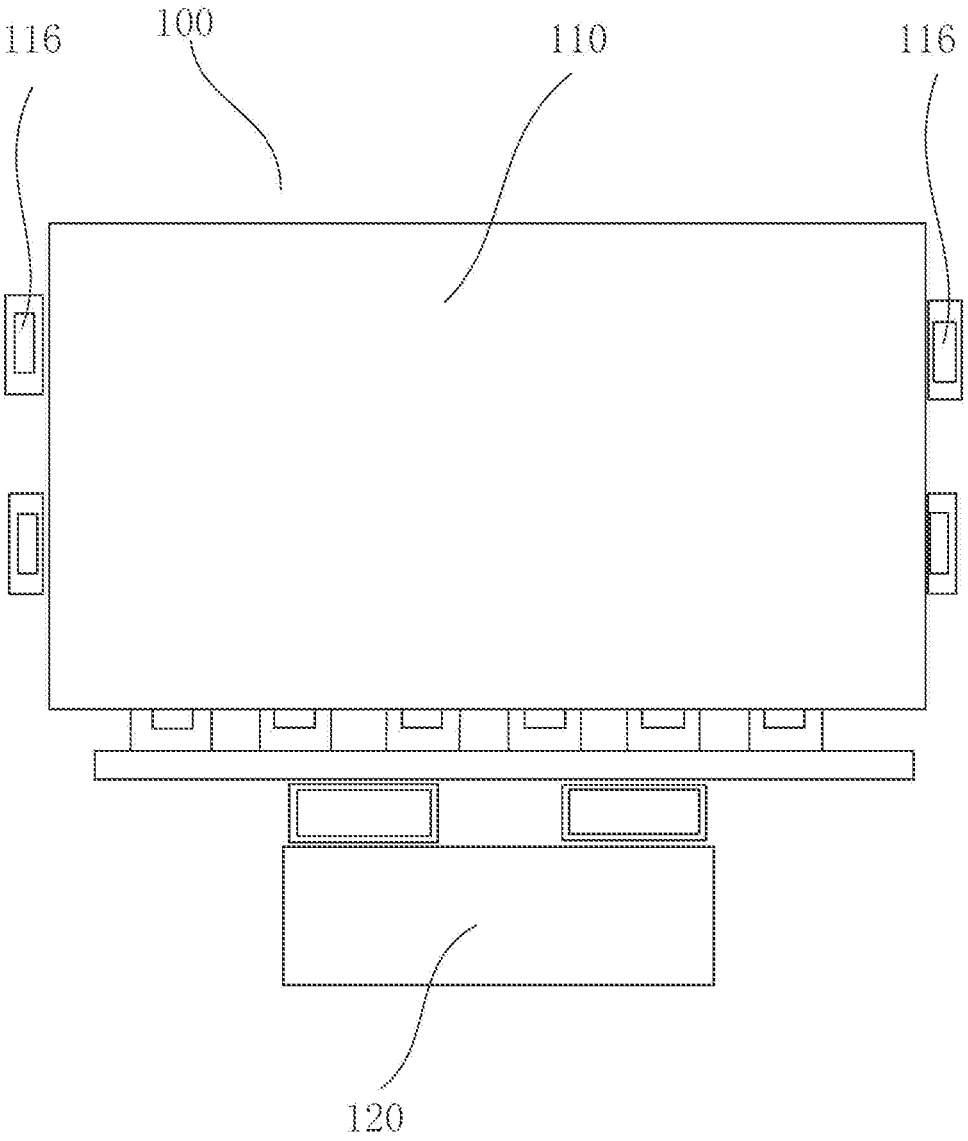
FIG. 1 is a schematic diagram of a display device according to an embodiment of this application.
Figure 2:
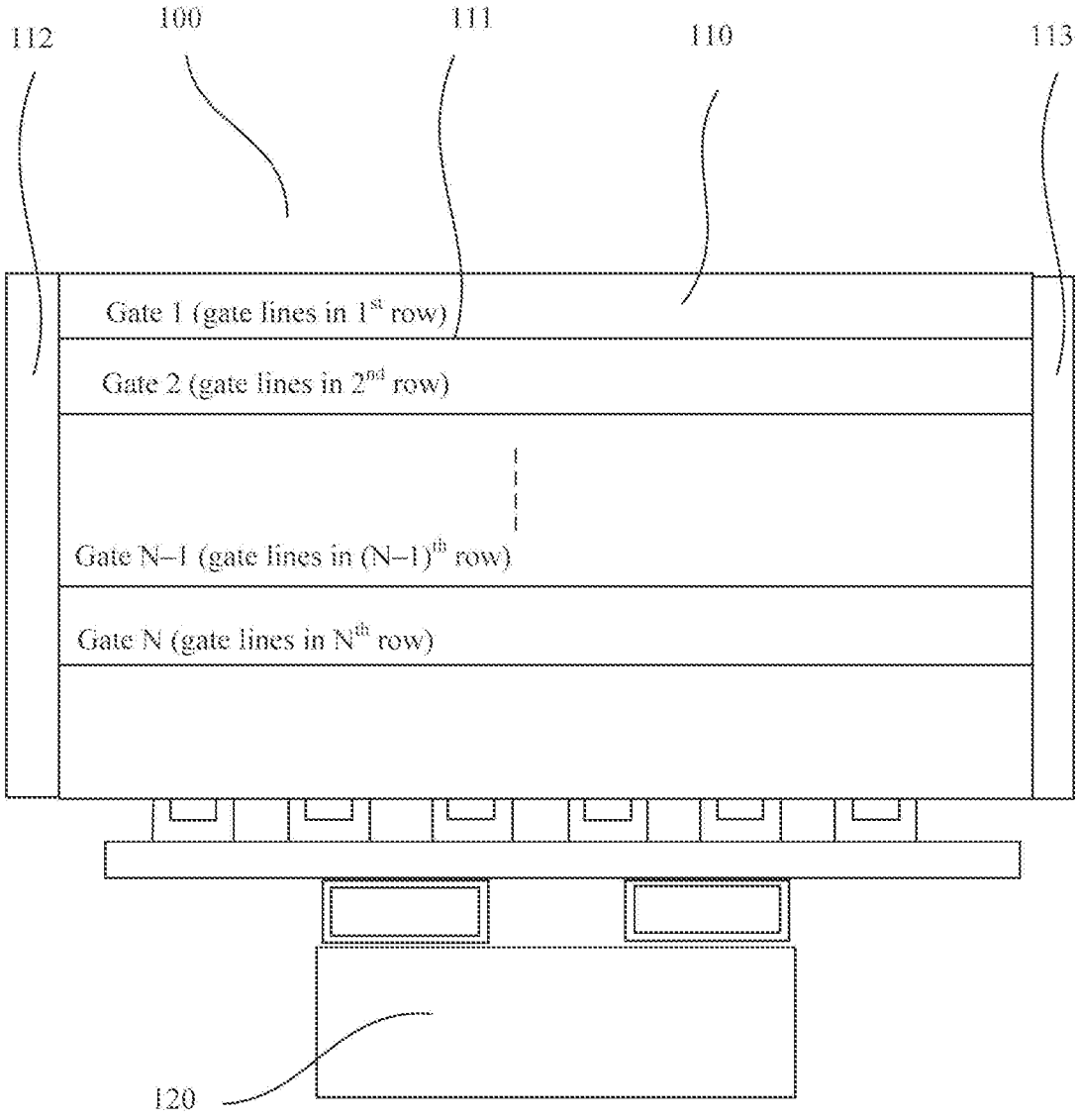
FIG. 2 is a schematic diagram of another display device according to an embodiment of this application.
Figure 3:
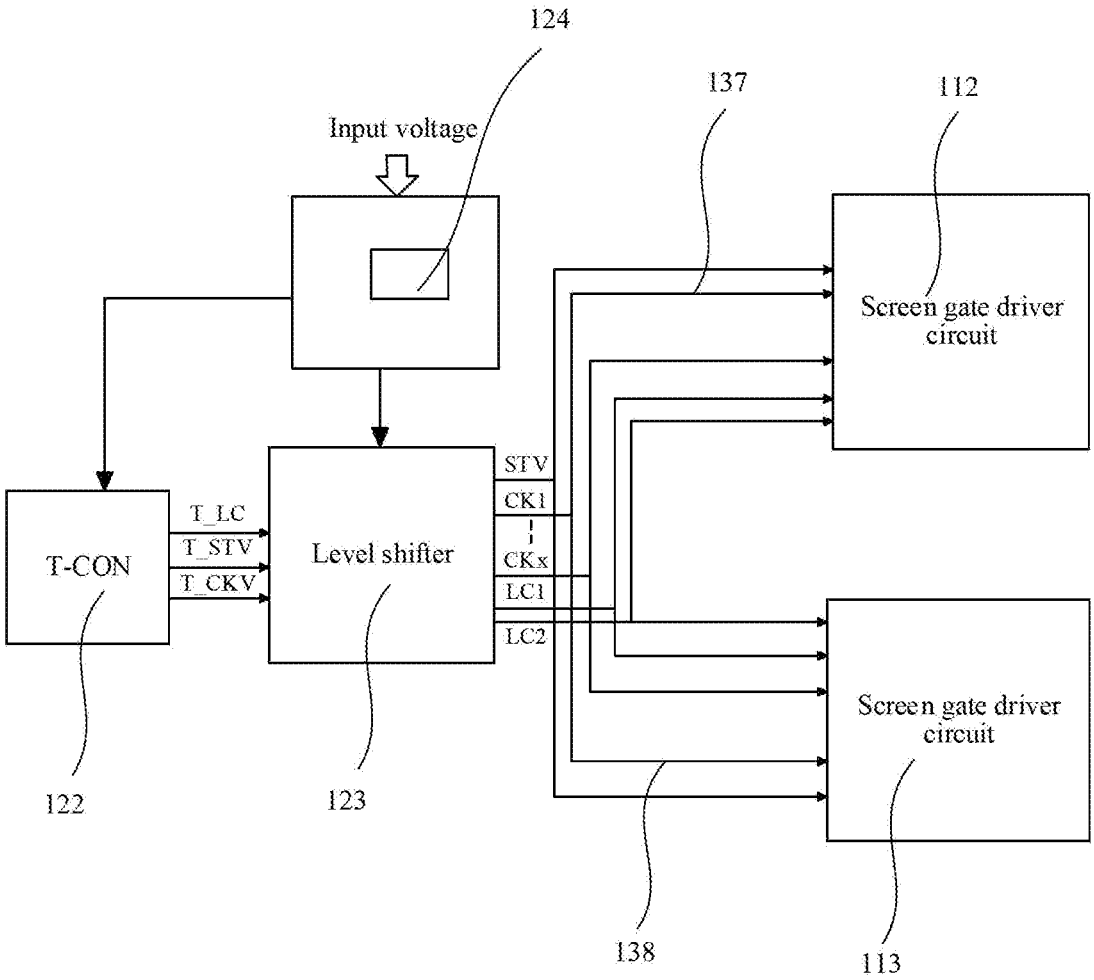
FIG. 3 is a schematic architectural diagram of circuit drive of a display device according to an embodiment of this application.

As shown in FIG. 1, a large-sized liquid crystal display panel 110 often has a gate driver 116 at each of left and right sides for bilateral driving. With development of technologies, as shown in FIG. 2, implementation of the function of the gate driver 116 in plane (GOA) will become a trend, and various panel manufacturers also successively develop gate driver on array products. A conventional screen gate driver architecture on the display panel 110 is shown in FIG. 3. A power supply chip 124 converts an input voltage to obtain a voltage required by a timing controller 122 (T-CON) and a level shifter 123 (Level shifter). The timing controller 122 outputs, a logic level signal to the level shifter 123, and the logic level signal is, converted into a level drive signal to be transmitted to the screen gate driver circuit at each of the left and right sides of the display panel 110. After the screen gate driver circuit operates normally, gate lines 111 in the display panel 110 are then activated row by row.

During a production process of the display panel 110, damage of a screen gate driver circuit at one side caused by electrostatic stroke or another factor easily occurs, and damage of the screen gate driver circuit at one side may affect a drive signal of the other screen gate driver circuit, and affect a display effect of the display panel 110, and therefore usually has to be scrapped.

This application is described below with reference to the accompanying drawings and embodiments.

Figure 4:
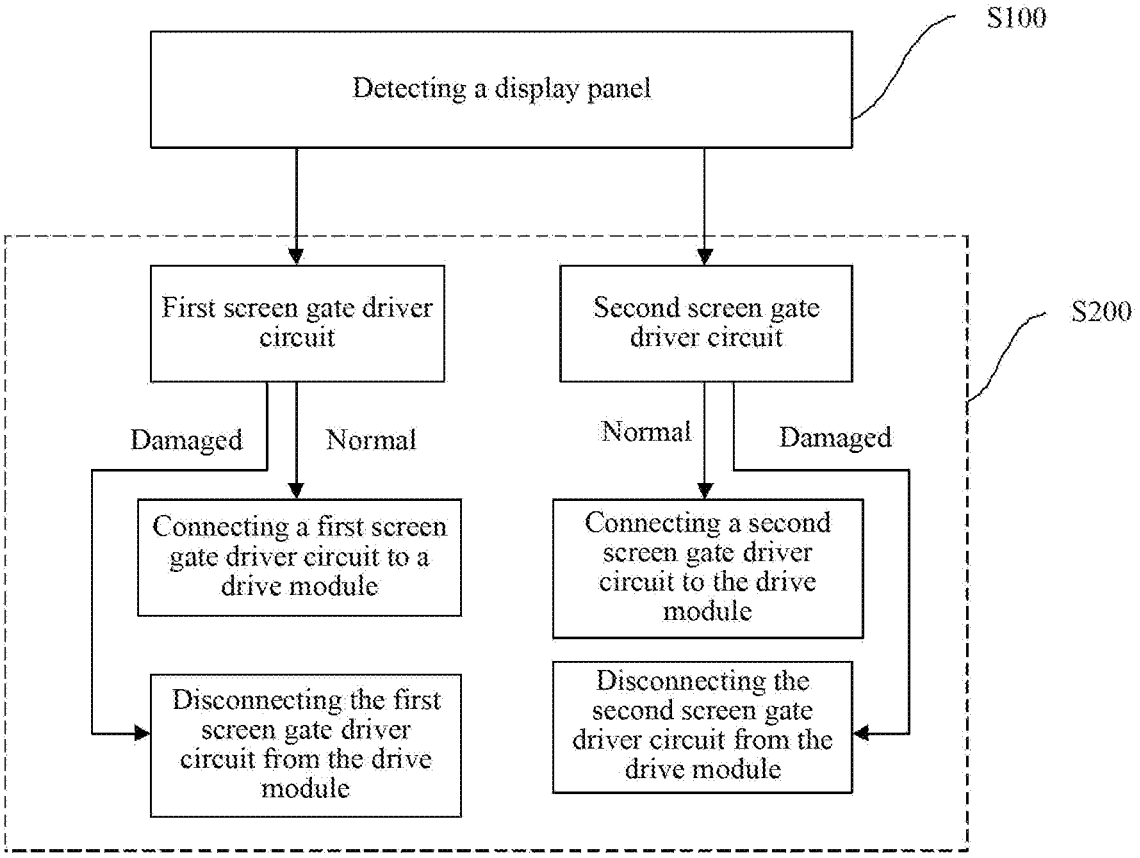
FIG. 4 is a schematic diagram of a preparing procedure of a display device according to an embodiment of this application.
Figure 5:
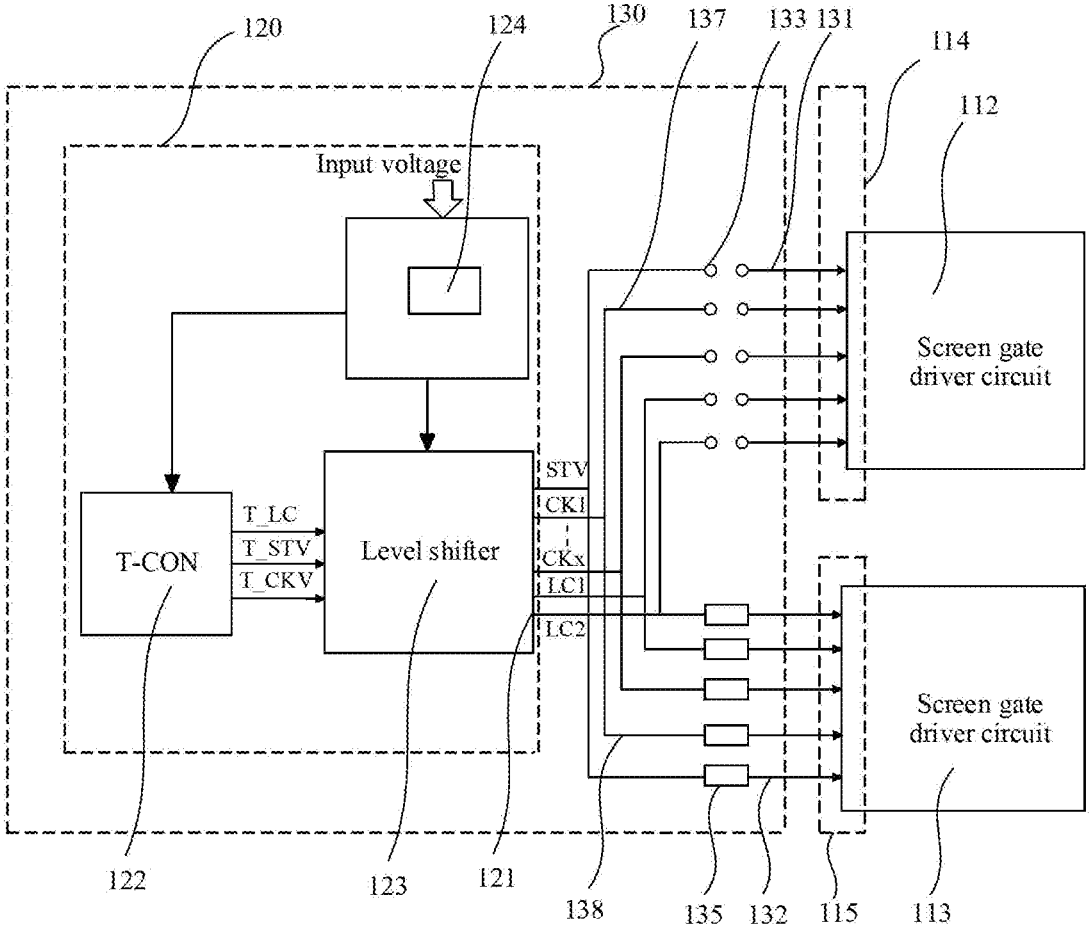
FIG. 5 is a schematic architectural diagram of circuit drive of another display device according to an embodiment of this application.
Figure 6:
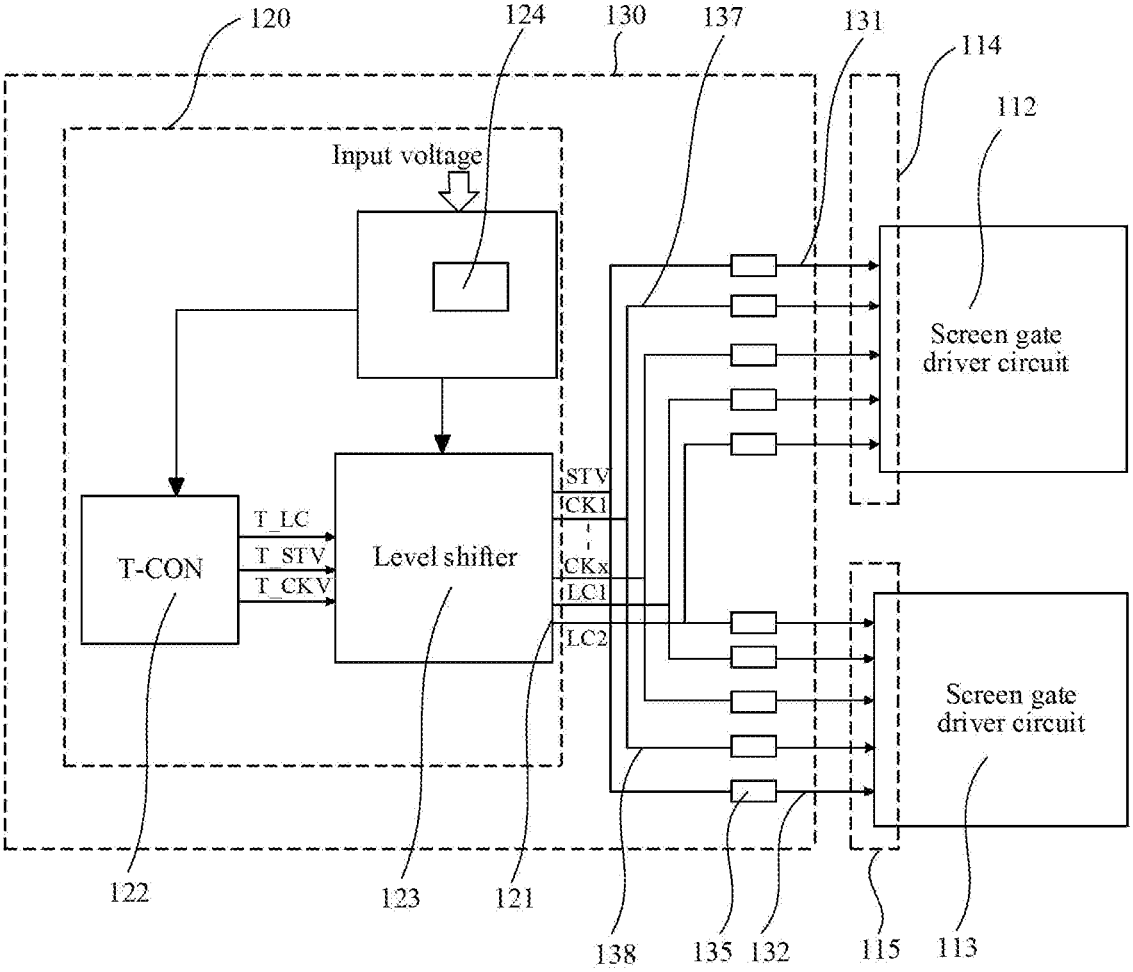
FIG. 6 is a schematic architectural diagram of circuit drive of another display device according to an embodiment of this application.

As shown in FIG. 4 to FIG. 6, an embodiment of this application discloses a method for manufacturing a display device 100. The display device 100 includes a display panel 110 and a driver chip 120 coupled to the display panel 110. The display panel 110 includes: gate lines 111; and a first screen gate driver circuit 112 and a second screen gate driver circuit 113 that correspond to a same group of gate lines 111.

The manufacturing method includes the following steps:

S100: detecting whether the first screen gate driver circuit 112 and the second screen gate driver circuit 113 are normal; and S200: when a detection result is "normal", connecting the first screen gate driver circuit 112 and/or the second screen gate driver circuit 113 to the driver chip 120; or when a detection result is "damaged", enabling the first screen gate driver circuit 112 and/or the second screen gate driver circuit 113 to be physically disconnected from the driver chip 120.

The display device 100 is mainly coupled by using the display panel 110 and the driver chip 120, and the driver chip 120 transmits a screen gate driver signal to a screen gate driver circuit of the display panel 110, to activate the gate lines 111 in the display panel 110, thereby making the display device 100 normally perform display. Generally, the display panel 110 is provided with two screen gate driver circuits, namely, the first screen gate driver circuit 112 and the second screen gate driver circuit 113, which correspond to a same group of gate lines 111. The display panel 110 is bilaterally driven, and an output of the first screen gate driver circuit 112 is connected to an output of the second screen gate driver circuit 113. If the second screen gate driver circuit 113 is abnormal for display, the output of the normal first screen gate driver circuit 112 is also affected. During a production process of the display panel 110, damage of a screen gate driver circuit at one side caused by electrostatic stroke or another factor easily occurs, and any one of the first screen gate driver circuit 112 and the second screen gate driver circuit 113 being damaged, a drive signal of the other screen gate driver circuit is affected, affecting a display effect of the display panel 110. Consequently, the display panel 110 is scrapped.

After being manufactured and before being correspondingly connected to the driver chip 120, the display panel 110 is first detected, to detect whether the first screen gate driver circuit 112 and the second screen gate driver circuit 113 are normal. If the first screen gate driver circuit 112 and/or the second screen gate driver circuit 113 are abnormal, the first screen gate driver circuit 112 and the second screen gate driver circuit 113 of the display panel 110 that is originally required to be scrapped are accurately tested, to find out a damaged screen gate driver circuit and a normal screen gate driver circuit, and the damaged screen gate driver circuit is physically disconnected from a corresponding signal cable, so that the normal screen gate driver circuit can receive a screen gate driver signal, and the damaged screen gate driver circuit does not receive a screen gate driver signal. In this case, the damaged screen gate driver circuit is not connected to the normal screen gate driver circuit, and does not affect the drive signal received by the normal screen gate driver circuit. and the normal screen gate driver circuit can individually drive the display panel 110 to operate normally, thereby avoiding scrapping of the display panel 110 and improving the yield of display devices 100.

The driver chip 120 is arranged on a driver circuit board 130, and the driver circuit board 130 is provided with a first output lead 131 and a second output lead 132. Correspondingly, the first screen gate driver circuit 112 is provided with a first signal receiving end 114, connected to the first output lead 131 of the driver circuit board 130, and the second screen gate driver circuit 113 is provided with a second signal receiving end 115, connected to the second output lead 132 of the driver circuit board 130. An on/off point 133 is provided between an output end 121 of the driver chip 120 and each of the first output lead 131 and the second output lead 132 of the driver circuit board 130. In the manufacturing method, when the detection result is "normal", the on/off point 133 corresponding to each of the first output lead 131 and/or the second output lead 132 is connected; or when the detection result is "damaged", the on/off point 133 corresponding to each of the first output lead 131 and/or the second output lead 132 is physically disconnected.

An on/off point 133 is provided between the output end 121 of the driver chip 120 and each of the first output lead 131 and the second output lead 132 of the driver circuit board 130, so that the first output lead 131 and/or the second output lead 132 can be easily disconnected from the output end 121 of the driver chip 120. To be specific, the first screen gate driver circuit 112 and/or the second screen gate driver circuit 113 can be easily connected to and disconnected from the driver chip 120.

The on/off point 133 includes a solder pad 134. When two end points of the solder pad 134 are connected, the on/off point 133 is connected; or when two end points of the solder pad 134 are disconnected, the on/off point 133 is disconnected. The solder pad 134 is an implementation of the on/off point 133. When the two end points of the solder pad 134 are connected, the on/off point 133 is connected; or when the two end points of the solder pad 134 are disconnected, the on/off point 133 is disconnected.

The on/off point 133 is connected by soldering a zero ohm resistor 135 between the two end points of the solder pad 134, and is disconnected by skipping soldering the two end points of the solder pad and making the solder pad vacant.

The on/off point 133 is connected by soldering the zero ohm resistor 135 between the two end points of the solder pad 134, to connect the driver chip 120 and the screen gate driver circuit, so that the screen gate driver signal is received. The on/off point 133 is disconnected by skipping soldering the two end points of the solder pad 134 and making the solder pad 134 vacant, to disconnect the driver chip 120 from the screen gate driver circuit, and consequently, the screen gate driver signal is not received. The zero ohm resistor 135 is a resistor having a very small resistance value, has a good electrical conduction effect, and can function as the conducting wire 136. However, compared, with the conducting wire 136, the zero ohm resistor 135 can be arranged or removed to change a layout of signal cables according to signal transferring requirements, and it is very convenient. If the driver chip 120 and the first screen gate driver circuit 112 need to be connected, the zero ohm resistor 135 is soldered on the solder pad 134 between the first output lead 131 and the output end 121 of the driving device, to connect the driver chip 120 and the first screen gate driver circuit 112. If the driver chip 120 is required to be physically disconnected from the first screen gate driver circuit 112, the zero ohm resistor 135 is not soldered on the solder pad 134 between the first output lead 131 and the output end 121 of the driving device, to disconnect the driver chip 120 from the first screen gate driver circuit 112. To perform the operation is very convenient, and does not affect another cable of the driver circuit board 130.

Figure 7:
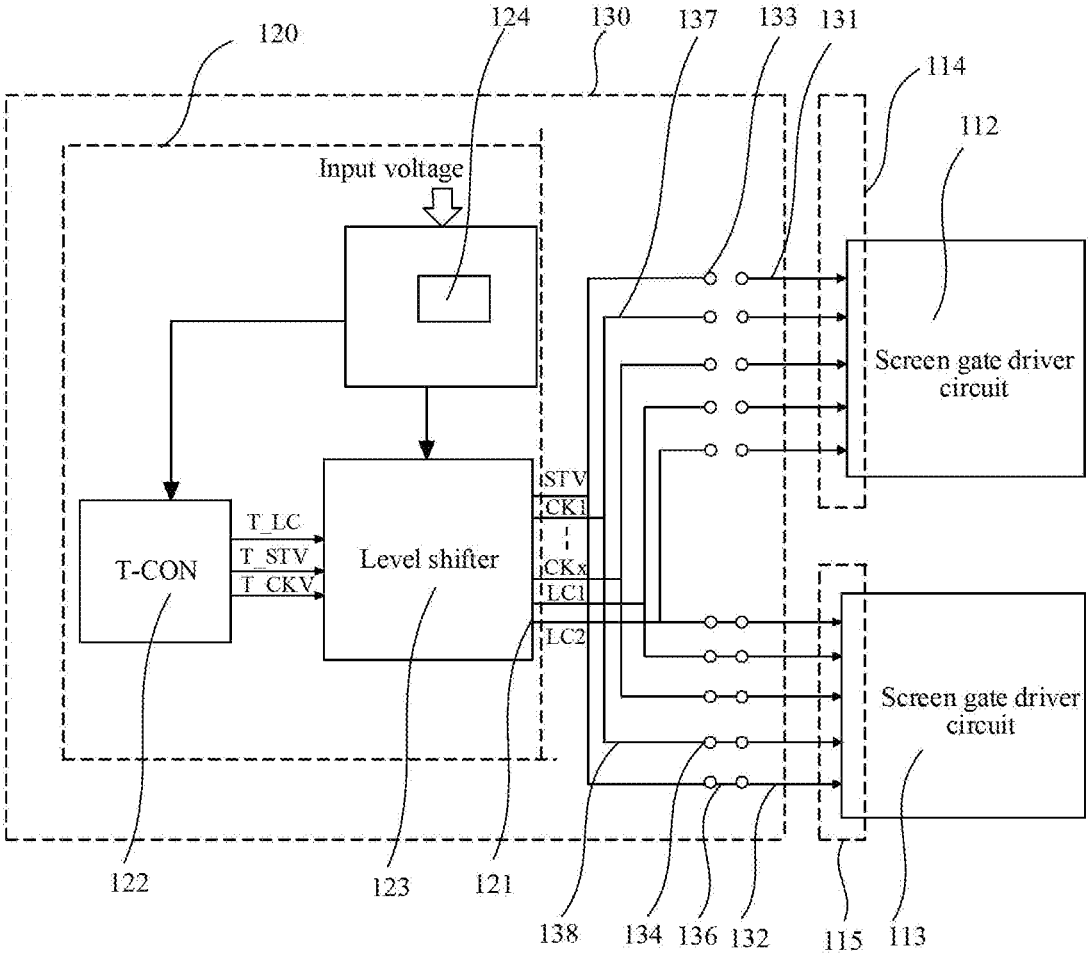
FIG. 7 is a schematic architectural diagram of circuit drive of another display device according to an embodiment of this application.
Figure 8:
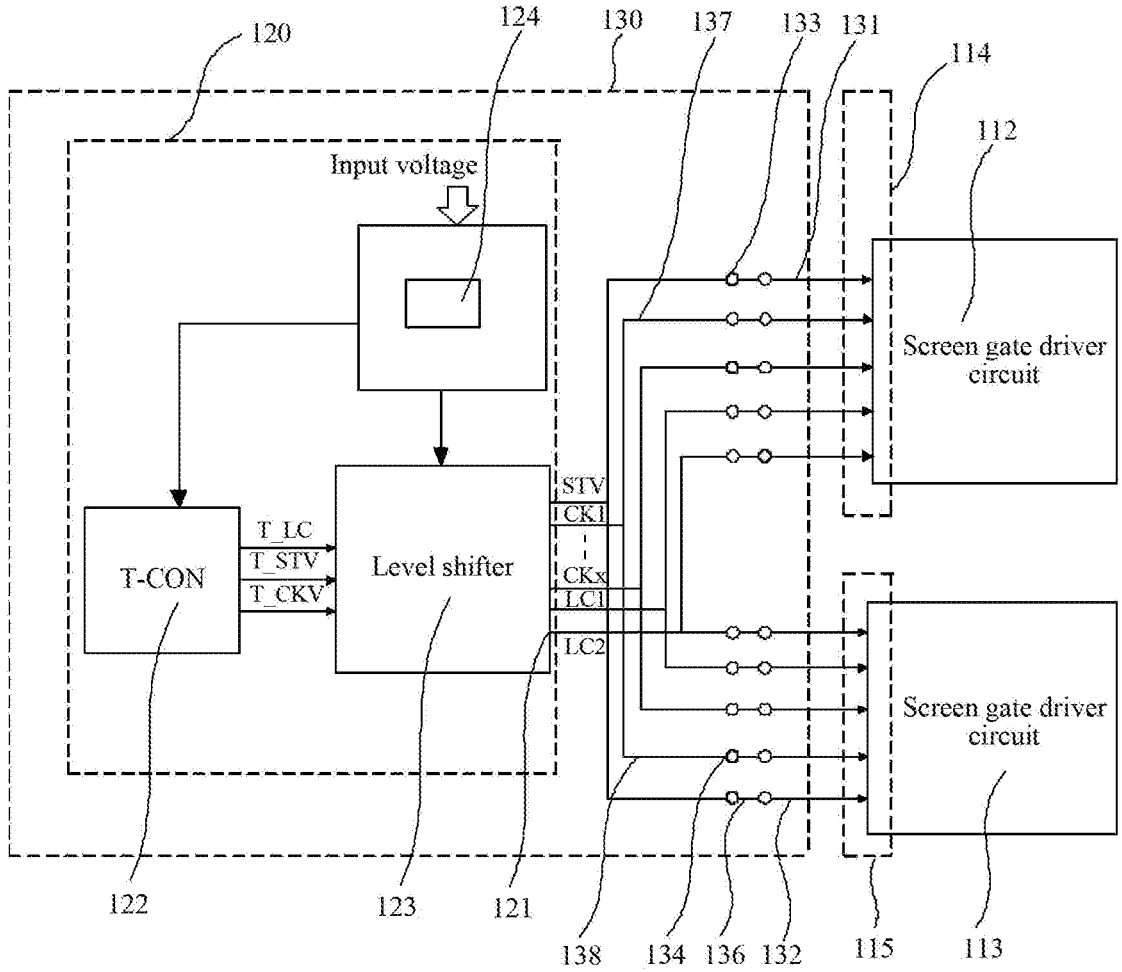
FIG. 8 is a schematic architectural diagram of circuit drive of another display device according to an embodiment of this application.

Referring to FIG. 7 to FIG. 8, a difference from the foregoing embodiment lies in that, the on/off point 133 is connected by connecting the conducting wire 136 between the two end points of the solder pad 134, and is physically disconnected by disconnecting the conducting wire 136 connected between the two end points. Further, the on/off point 133 may be connected by connecting the conducting wire 136 between the two end points of the solder pad 134. The on/off point 133 can be disconnected by simply disconnecting the conducting wire 136 connected between the two end points of the solder pad 134. The operation is simple and is easy to implement.

In one or more embodiments of this application, referring to FIG. 5 to FIG. 8, a difference from the foregoing embodiment lies in that the output end 121 of the driver chip 120 is connected to the first output lead 131 by using a first signal cable group 137, and the output end 121 of the driver chip 120 is connected to the second output lead 132 by using a second signal cable group 138. The screen gate driver signal includes a frame start control signal STV, a clock signal CK, and a low frequency clock signal LC. After being output from the output end 121 of the driver chip 120, the frame start control signal STV, the clock signal CK, and the low frequency clock signal LC are transmitted through the first signal cable group 137 to the first screen gate driver circuit 112, and are transmitted through the second signal cable group 138 to the<second screen gate driver circuit 113. The first signal cable group 137 includes a frame start control signal cable, a plurality of clock signal cables having a same quantity as that of the clock signals CK, and a plurality of low frequency clock signal cables having a same quantity as that of the low frequency clock signals LC. The second signal cable group 138 includes a frame start control signal cable, a plurality of clock signal cables having a same quantity as that of the clock signals CK, and a plurality of low frequency clock signal cables having a same quantity as that of the low frequency clock signals LC. In the first signal cable group 137 and the second signal cable group 138, each signal cable is provided with an on/off point 133. In the screen gate driver circuit, gate lines 111 of the display panel 110 can only be activated by synergy of the frame start control signal STV, the clock signal CK, and the low frequency clock signal LC, to drive the display panel 110 to operate normally. Each screen gate driver signal needs a corresponding signal cable transmit signal, and therefore a quantity of signal cables is the same as a quantity of screen gate driver signals. The first signal cable group 137 corresponds to the first screen gate driver circuit 112, the second signal cable group 138 corresponds to the second screen gate driver circuit 113, and types and quantities of signals received by the first screen gate driver circuit 112 and the second screen gate driver circuit 113 are both the same. Therefore, a quantity of signal cables of the first signal cable group 137 is the same as, a quantity of signal cables of the second signal cable group 138, and both are equal to a quantity of frame start control signals, a quantity of clock signals, and a quantity of low frequency clock signals required by a single screen gate driver circuit.

If it is detected that the first screen gate driver circuit 112 is normal, and the second screen gate driver circuit 113 is damaged, each connecting/disconnecting point 133 on the first signal cable group 137 is connected, and each connecting/disconnecting point 133 on the second signal cable group 138 is disconnected, so that the first screen gate driver circuit 112 receives a screen gate driver signal, and the second screen gate driver circuit 113 cannot receive a screen gate driver signal. In this case, the screen gate driver signal received by the first screen gate driver circuit 112 is not affected by the second screen gate driver circuit 113, and can unilaterally drive the display panel 110 to operate normally.

On the contrary, if it is detected that the first screen gate driver circuit 112 is damaged, and the second screen gate driver circuit 113 is normal, each connecting/disconnecting point 133 on the first signal cable group 137 is connected, and each connecting/disconnecting point 133 on the second signal cable group 138 is disconnected, so that the first screen gate driver circuit 112 cannot receive a screen gate driver signal, and the second screen gate driver circuit 113 receives a screen gate driver signal. In this case, the screen gate driver signal received by the second screen gate driver circuit 113 is not affected by the first screen gate driver circuit 112, and can unilaterally drive the display panel 110 to operate normally.

If it is detected that the first screen gate driver circuit 112 and the second screen gate driver circuit 113 are both normal, each connecting/disconnecting, point 133 on the first signal cable group 137 is connected, and each connecting/disconnecting point 133 on the second signal cable group 138 is connected, so that both the first signal receiving end 114 and the second signal receiving end 115 are connected to the signal output end 121, to receive a screen gate driver signal. The first screen gate driver circuit 112 and the second screen gate driver circuit 113 receive a same screen gate driver signal, and do not affect each other, and can bilaterally drive the display panel 110 to operate normally.

Figure 9:
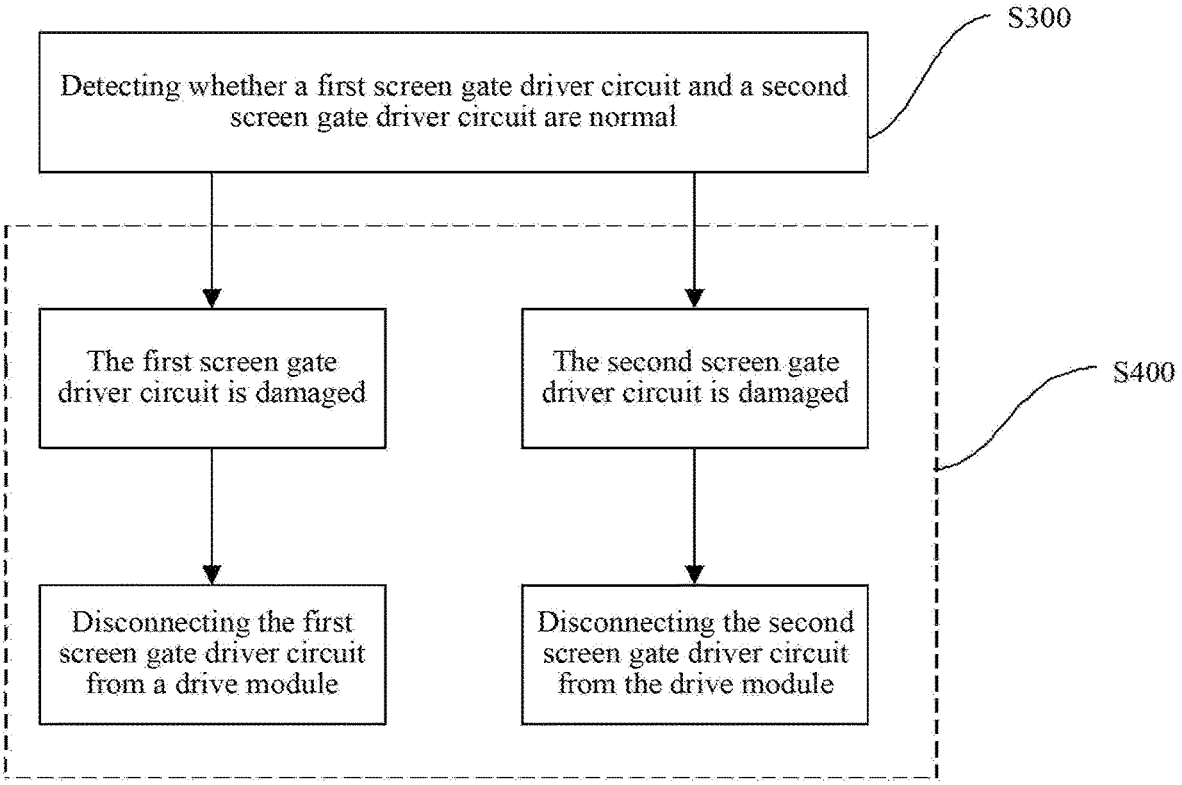
FIG. 9 is a schematic diagram of a repair procedure of a display device according to an embodiment of this application.
Figure 10:
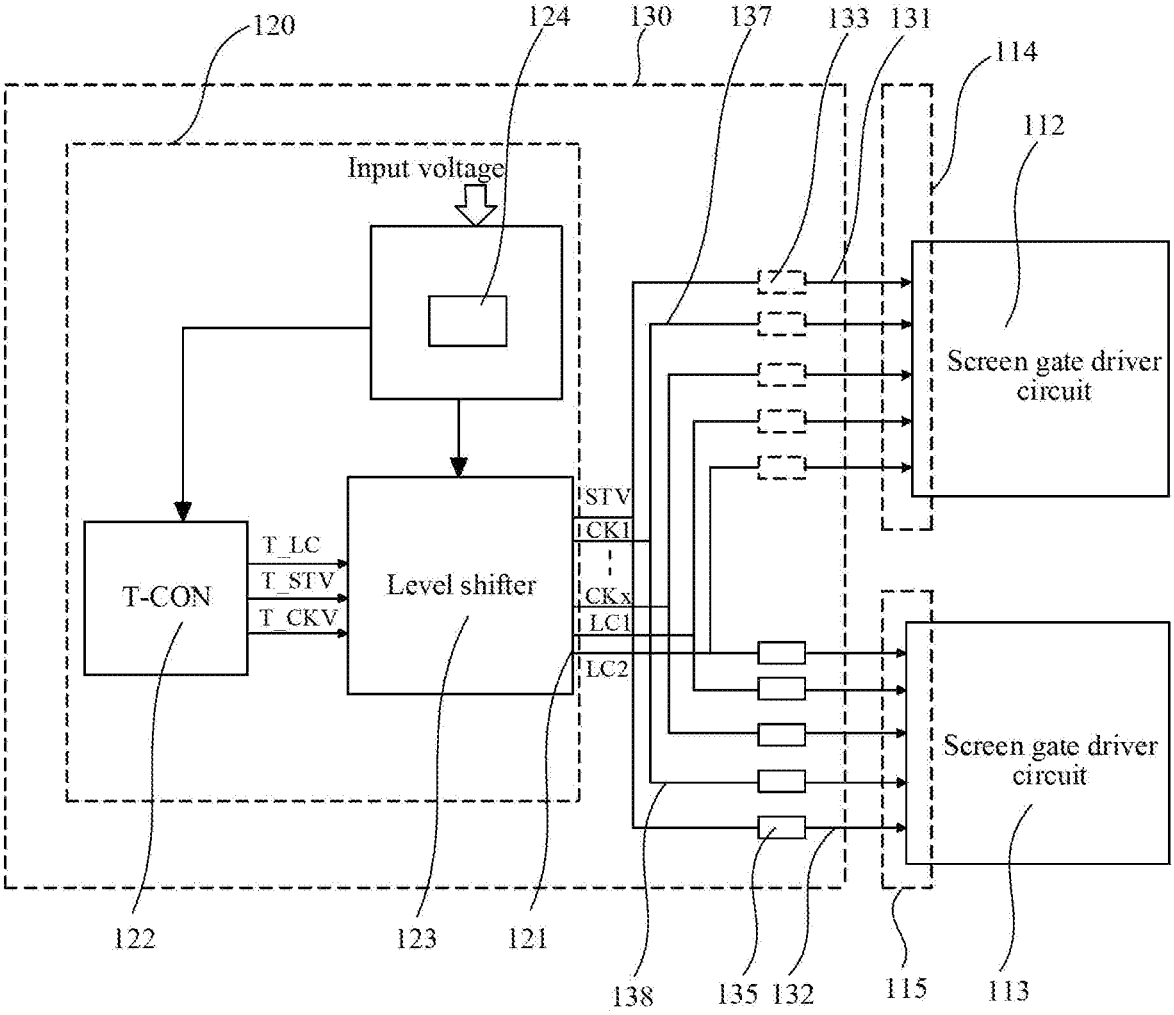
FIG. 10 is a schematic architectural diagram of circuit drive of another display device according to an embodiment of this application.

In one or more embodiments of this application, referring to FIG. 9 to FIG. 10, a method for repairing a display device 100 is disclosed. The display device 100 includes a display panel 110 and a driver chip 120 coupled to the display panel 110.

A first screen gate driver circuit 112 and a second screen gate driver circuit 113 are separately provided at two sides of the display panel 110, the driver chip 120 is physically connected to the first screen gate driver circuit 112 and the second screen gate driver circuit 113, and one of the first screen gate driver circuit 112 and the second screen gate driver circuit 113 is damaged.

The repair method includes the following steps:

S300: detecting whether the first screen gate driver circuit 112 and the second screen gate driver circuit 113 are normal; and S400: when it is detected that the first screen gate driver circuit 112 is damaged, physically disconnecting the driver chip 120 from the first screen gate driver circuit 112; or when it is detected that the second screen gate driver circuit 113 is damaged, physically disconnecting the driver chip 120 from the second screen gate driver circuit 113.

In the solution, if a manufactured display device 100 is scrapped due to damage of a screen gate driver circuit at one side on the display panel 110, production resources are wasted, and the yield of display devices 100 is reduced. In the repair method for the display device 100 in which, a screen gate driver circuit at one side is damaged, whether the first screen gate driver circuit 112 and the second screen gate driver circuit 113 on the display panel 110 are normal is first detected. If the first screen gate driver circuit 112 is damaged and the second screen gate driver circuit 113 is normal, a connection between the driver chip 120 and the first screen gate driver circuit 112 is disconnected, to make the first screen gate driver circuit 112 not receive a screen gate driver signal, make the first screen gate driver circuit 112 not affect a screen gate driver signal received by the second screen gate driver circuit 113, and further make the second screen gate driver circuit 113 individually drive the display panel 110 to operate normally. On the contrary, if the first screen gate driver circuit 112 is normal and the second screen gate driver circuit 113 is damaged, a connection between the driver chip 120 and the second screen gate driver circuit 113 is disconnected, to reach an effect that the first screen gate driver circuit 112 individually drive the display panel 110 to operate normally, The repair method is used, so that the display panel 110 that should be scrapped can continue to be used normally, thereby saving resources, and improving the yield of display devices 100.

The driver chip 120 is arranged on the driver circuit board 130, and the driver circuit board 130 is provided with the first output lead 131 and the second output lead 132. Correspondingly, the first screen gate driver circuit 112 is provided with a first signal receiving end 114, connected to the first output lead 131 of the driver circuit board 130; and the second screen gate driver circuit 113 is provided with a second signal receiving end 115, connected to the second output lead 132 of the driver circuit board 130. The solder pad 134 is provided between the output end 121 of the driver chip 120 and each of the first output lead 131 and the second output lead 132 of the driver circuit board 130, where two end points of the solder pad 134 are connected. In the repair method, when it is detected that the first screen gate driver circuit 112 is damaged, the two end points of the solder pad 134 between the output end 121 and the first output lead 131 are physically disconnected; and when it is detected that the second screen gate driver circuit 113 is damaged, the two end points of the solder pad 134 between the output end 121 and the second output lead 132 are physically disconnected.

The solder pad 134 is provided between the output end 121 of the driver chip 120 and each of the first output lead 131 and the second output lead 132 of the driver circuit board 130. When the first screen gate driver circuit 112 and the second screen gate driver circuit 113 are normal, the two end points of the solder pad 134 are connected. When the first screen gate driver circuit 112 or the second screen gate driver circuit 113 is damaged, the two end points of the solder pad 134 between the output end 121 of the corresponding driver chip 120 and the first output lead 131 or the second output lead 132 may be physically disconnected, so that the damaged display panel 110 is repaired and can be normally used. The operation is simple and is easy to implement.

In one or more embodiments, two ends of the solder pad 134 are connected by soldering a zero ohm resistor 135 between the two end points of the solder pad 134, In the repair method, when it is detected that the first screen gate driver circuit 112 is damaged, the zero ohm resistor 135 between the two end points of the solder pad 134 between the output end 121 and the first output lead 131 is parted off, to physically disconnect the first screen gate driver circuit 112 from the driver chip 120. When it is detected that the second screen gate driver circuit 113 is damaged, the zero ohm resistor 135 between the two end points of the solder pad 134 between the output end 121 and the second output lead 132 is parted off, to physically disconnect the second screen gate driver circuit 113 from the driver chip 120.

Specifically, parting off means removing, and not soldering the zero ohm resistor 135. On the contrary, parting on means soldering the zero ohm resistor 135. The screen gate driver circuit and the driver chip 120 are connected by soldering the zero ohm resistor 135 between the two end points of the solder pad 134. The zero ohm resistor 135 may be parted off according to requirements, to achieve an effect that the first screen gate driver circuit 112 or the second screen gate driver circuit 113 is physically disconnected from the driver chip 120. When the first screen gate driver circuit 112 is damaged and the second screen gate driver circuit 113 is normal, The zero ohm resistor 135 located between the two end points of the solder pad 134 between the output end 121 and the first output lead 131 is parted off. Similarly, when the first screen gate driver circuit 112 is normal and the second screen gate driver circuit 113 is damaged, The zero ohm resistor 135 located between the two end points of the solder pad 134 between the output end 121 and the second output lead 132 is parted off. The operation is simple and convenient. A display device 100 that should be scrapped can be used normally by using the simple operation, thereby greatly saving resources, and improving the yield of display devices 100.

In one or more embodiments of this application, referring to FIG. 10, a display device 100 is disclosed. including: a display panel 110; and a driver chip 120, coupled to the display panel 110. The display panel 110 includes: gate lines 111; and a first screen gate driver circuit 112 and a second screen gate driver circuit 113 that correspond to a same group of gate lines 111. In the first screen gate driver circuit 112 and the second screen gate driver circuit 113, at least one screen gate driver circuit is connected to the driver chip 120, and at least one screen gate driver circuit is physically disconnected from the driver chip 120.

Specifically, the driver chip 120 is arranged on a driver circuit board 130, and the driver circuit board 130 is provided with a first output lead 131 and a second output lead 132. Correspondingly, the first screen gate driver circuit 112 is provided with a first signal receiving end 114, connected to the first output lead 131 of the driver circuit board 130; and the second screen gate driver circuit 113 is provided with a second signal receiving end 115, connected to the second output lead 132 of the driver circuit board 130.

An output end 121 of the driver chip 120 is connected to the first output lead 131 by using a first signal cable group 137, and the output end 121 of the driver chip 120 is connected to the second output lead 132 by using a second signal cable group 138.

Connecting/disconnecting points 133 are provided on each of the first signal cable group 137 and the second signal cable group 138. In the first screen gate driver circuit 112 and the second screen gate driver circuit 113, at least one screen gate driver circuit is connected to the driver chip 120, and at least one screen gate driver circuit is physically disconnected from the driver chip 120. Correspondingly, connecting/disconnecting points 133 are provided on each of the first signal cable group 137 and the second signal cable group 138. When each of the on/off points 133 on the first signal cable group 137 is connected, the first screen gate driver circuit 112 and the driver chip 120 are connected. When each of the on/off points 133 on the first signal cable group 137 is disconnected, the first screen gate driver circuit 112 is physically disconnected from the driver chip 120. Similarly, when each of the on/off points 133 on the second signal cable group 138 is connected, the second screen gate driver circuit 113 and the driver chip 120 are connected. When each of the on/off points 133 on the second signal cable group 138 is disconnected, the second screen gate driver circuit 113 is physically disconnected from the driver chip 120.

The screen gate driver circuit disconnected from the driver chip 120 does not receive a screen gate driver signal, and a screen gate driver circuit connected to the driver chip 120 receives a screen gate driver signal. The two screen gate driver circuits do not affect each other. The screen gate driver circuit connected to the driver chip 120 can normally drive the display panel 110 to perform display operation, and the display panel 110 is unilaterally driven. This avoids a case in which the entire display panel 110 or the display device 100 is scrapped due to damage of the screen gate driver circuit at one side, thereby saving resources, and increasing the yield of display devices 100.

In one or more embodiments of this application, referring to FIG. 10, a display device 100 is disclosed, including: a display panel 110; and a driver chip 120 coupled to the display panel 110. The display panel 110 includes: gate lines 111; and a first screen gate driver circuit 112 and a second screen gate driver circuit 113 that correspond to a same group of gate lines 111, where the first screen gate driver circuit 112 is damaged, and the second screen gate driver circuit 113 is normal.

The driver chip 120 is arranged on a driver circuit board 130, and the driver circuit board 130 is provided with a first output lead 131 and a second output lead 132. Correspondingly, the first screen gate driver circuit 112 is provided with a first signal receiving end 114, connected to the first output lead 131 of the driver circuit board 130; and the second screen gate driver circuit 113 is provided with a second signal receiving end 115, connected to the second output lead 132 of the driver circuit board 130. An output end 121 of the driver chip 120 is connected to the first output lead 131 by using a first signal cable group 137, and the output end 121 of the driver chip 120 is connected to the second output lead 132 by using a second signal cable group 138. The first signal cable group 137 includes a frame start control signal cable, a plurality of clock signal cables having a same quantity as that of the clock signals CK, and a plurality of low frequency clock signal cables having a same quantity as that of the low frequency clock signals LC. The second signal cable group 138 includes a frame start control signal cable, a plurality of clock signal cables having a same quantity as that of the clock signals CK, and a plurality of low frequency clock signal cables having a same quantity as that of the low frequency clock signals LC. In the first signal cable group 137 and the second signal cable group 138, each signal cable is provided with a solder pad 134. In addition, a zero ohm resistor 135 between two end points of the solder pad 134 on each signal cable of the first signal cable group 137 is parted off, and a zero ohm resistor 135 between two end points of the solder pad 134 on each signal cable of the second signal cable group 138 is parted on.

Specifically, the driver chip 120 includes a timing controller 122 and a level shifter 123. The timing controller 122 outputs a logic level signal, and the level shifter 123 receives the logic level signal output by the timing controller 122, and converts the logic level signal to a screen gate driver signal. The logic level signal output by the timing controller 122 includes: a frame start timing control signal T_STV, a timing clock signal T_CKV, and a low frequency timing clock signal T_LC. The frame start timing control signal T_STV, the timing clock signal T_CKV, and the low frequency timing clock signal T_LC are converted through the level shifter 123 to be a frame start control signal STV a clock signal CK, and a low frequency clock signal LC. The level shifter 123 outputs the frame start control signal STV, the clock signal CK, and the low frequency clock signal LC respectively through a corresponding port. The output frame start control signal STV, clock signal CK, and low frequency clock signal LC are transmitted through the first signal cable group 137 to the first screen gate driver circuit 112, and are transmitted through the second signal cable group 138 to the second screen gate driver circuit 113.

The clock signal specifically includes a CK1, and a CK2 to a CKx, where x>1. The low frequency clock signal specifically includes a LC1 and a LC2. The display device 100 is mainly coupled by using the display panel 110 and the driver chip 120. Normally, the driver chip 120 transmits a screen gate driver signal through a signal cable to each of the first screen gate driver circuit 112 and the second screen gate driver circuit 113 on the display panel 110, to drive the display panel 110 to perform display normally. However, in a manufacturing process of the display panel 110, the entire display panel 110 or a display device 100 is scrapped due to damage of a screen gate driver circuit caused by electrostatic stroke or another factor, seriously wasting resources, and affecting a yield of products.

In the display device 100 of the solution, the first screen gate driver circuit 112 is damaged, and correspondingly, the screen gate driver circuit is physically disconnected from the driver chip 120 by parting off all zero ohm resistors 135 between two end points of the solder pad 134 on the first signal cable group 137. The second screen gate driver circuit 113 is normal, and the second screen gate driver circuit 113 and the driver chip 120 are connected by parting on all zero ohm resistors 135 between two end points of the solder pad 134 on the second signal cable group 138. Therefore, the first screen gate driver circuit 112 does not receive a screen gate driver signal, and the second screen gate driver circuit 113 receives a screen gate driver signal. The two screen gate driver circuits do not affect each other, and the second screen gate driver circuit 113 can normally drive the display panel 110 to perform display operation, so that the display panel 110 is unilaterally driven, avoiding a case in which the entire display panel 110 or the display device 100 is scrapped due to damage of the first screen gate driver circuit 112, thereby saving resources, and increasing the yield of display devices 100.

It should be noted that, for limitation on steps in the solution, on the premise of not affecting implementation of a specific solution, it is not considered that a particular order in which the steps are performed is limited. A step listed in front may be first performed, or may be subsequently performed, or the steps may even be simultaneously performed. Those steps that can implement the solution should all be considered as falling within the protection scope of this application.

The technical solution of this application may be widely applied to a Twisted Nematic (TN) panel, an In-Plane Switching (IPS) panel, or a Multi-domain Vertical Alignment (VA) panel, and may certainly be applied to any other suitable type of panel.

The foregoing content describes this application in detail with reference to the specific implementations, and it should not be regarded that the specific implementations of this application are limited to these descriptions. A person of ordinary skill in the art can further make simple deductions or replacements without departing from the concept of this application, and such deductions or replacements should all be considered as falling within the protection scope of this application.

What is claimed is:

1. A method for manufacturing a display device, wherein the display device comprises a display panel and a driver chip coupled to the display panel, wherein the display panel comprises:

gate lines;

a first screen gate driver circuit; and a second screen gate driver circuit, wherein the first screen gate driver circuit and the second screen gate driver circuit correspond to a same group of gate lines; and the manufacturing method comprises:

detecting whether the first screen gate driver circuit and the second screen gate driver circuit are normal; and when a detection result is "normal", connecting the first screen gate driver circuit and/or the second screen gate driver circuit to the driver chip; or when a detection result is "damaged", physically disconnecting the first screen gate driver circuit and/or the second screen gate driver circuit from the driver chip.

2. The method for manufacturing a display device according to claim 1, wherein the driver chip transmits a screen gate driver signal to the first screen gate driver circuit and the second screen gate driver circuit, to activate the gate line in the display panel.

3. The method for manufacturing a display device according to claim 2, wherein the driver chip is arranged on a driver circuit board, the driver circuit board is provided with a first output lead and a second output lead, and correspondingly, the first screen gate driver circuit is provided with a first signal receiving end, connected to the first output lead of the driver circuit board; and the second screen gate driver circuit is provided with a second signal receiving end, connected, to the second output lead of the driver circuit board; and an on/off point is provided between an output end of the driver chip and each of the first output lead and the second output lead of the driver circuit board.

4. The method for manufacturing a display device according to claim 3, wherein in the manufacturing method, when the detection result is "normal", the on/off point corresponding to each of the first output lead and/or the second output lead is connected; or when the detection result is "damaged", the on/off point corresponding'to each of the first output, lead and/or the second output lead is physically disconnected.

5. The method for manufacturing a display device according to claim 4, wherein the on/off point comprises a solder pad, wherein when two end points of the solder pad are connected, the on/off point is connected; or when two end points of the solder pad are disconnected, the on/off point is disconnected.

6. The method for manufacturing a display device according to claim 5, wherein the on/off point is connected by soldering a zero ohm resistor between the two end points of the solder, pad, and is disconnected by skipping' soldering the two end points of the solder pad and making the solder pad vacant.

7. The method for manufacturing a display device according to claim 5, wherein the on/off point is connected by connecting a conducting wire between the two end points of the solder pad, and is physically disconnected by disconnecting the conducting wire connected between the two end points.

8. The method for manufacturing a display device according to claim 4, wherein the output end of the driver chip is connected to the first output lead by using a first signal cable group, and the output end of the driver chip is connected to the second output lead by using a second signal cable group.

9. The method for manufacturing a display device according to claim 8, wherein the screen gate driver signal comprises a frame start control signal, a clock signal, and a low frequency clock signal, and after being, output from the output end of the driver chip, the frame start control signal, the clock signal, and the low frequency clock signal are transmitted through the first signal cable group to the first screen gate driver circuit, and are transmitted through the second signal cable group to the second screen gate driver circuit.

10. The method for manufacturing a display device according to claim 9, wherein the first signal cable group comprises a frame start control signal cable, a plurality of clock signal cables having a same quantity as that of the clock signals, and a plurality of low frequency clock signal cables having a same quantity as that of the low frequency clock signals; and the second signal cable group comprises a frame start control signal cable, a plurality of clock signal cables having a same quantity as that of the clock signals, and a plurality of low frequency clock signal cables having a same quantity as that of the low frequency clock signals; and in the first signal cable group and the second signal cable group, each signal cable is provided with an on/off point.

11. A method for repairing a display device, wherein the display device comprises a display panel and a driver chip coupled to the display panel, wherein a first screen gate driver circuit and a second screen gate driver circuit are separately provided at two sides of the display panel, the driver chip is physically connected to the first screen gate driver circuit and the second screen gate driver circuit, and one of the first screen gate driver circuit and the second screen gate driver circuit is damaged; and the repair method comprises:

detecting whether the first screen gate driver circuit and the second screen gate driver circuit are normal; and when it is detected that the first screen gate driver circuit is damaged, physically disconnecting the driver chip from the first screen gate driver circuit; or when it is detected that the second screen gate driver circuit is damaged, physically disconnecting the driver chip from the second screen gate driver circuit.

12. The method for repairing a display device according to claim 11, wherein the driver chip is arranged on a driver circuit board, and the driver circuit board is provided with a first output lead and a second output lead, and correspondingly, the first screen gate driver circuit is provided with a first signal receiving end, connected to the first output lead of the driver circuit board; and the second screen gate driver circuit is provided with a second signal receiving end, connected to the second output lead of the driver circuit board; and a solder pad is provided between an output end of the driver chip and each of the first output lead and the second output lead of the driver circuit board, wherein two end points of the solder pad are connected.

13. The method for repairing a display device according to claim 12, wherein in the repair method, when it is detected that the first screen gate driver circuit is damaged, physically disconnecting the two end points of the solder pad that is between the output end and the first output lead; or when it is detected that the second screen gate driver circuit is damaged, physically disconnecting the two end points of the solder pad that is between the output end and the second output lead.

14. The method for repairing a display device according to claim 13, wherein two ends of the solder pad are connected by soldering a zero ohm resistor between the two end points of the solder pad.

15. The method for repairing a display device according to claim 14, wherein in the repair method, when it is detected that the first screen gate driver circuit is damaged, parting off the zero ohm resistor soldered between the two end points of the solder pad between the output end and the first output lead, to physically disconnect the first screen gate driver circuit and the driver chip; or when it is detected that the second screen gate driver circuit is damaged, parting off the zero ohm resistor soldered between the two end points of the solder pad between the output end and the second output lead. to physically disconnect the second screen gate driver circuit and the driver chip.

16. A display device, comprising:

a display panel, and;

a driver chip, coupled to the display panel, wherein the display panel comprises;

gate lines; and a first screen gate driver circuit and a second screen gate driver circuit that correspond to a same group of gate lines, wherein in the first screen gate driver circuit and the second screen gate driver circuit, at least one screen gate driver circuit is connected to the driver chip, and at least one screen gate driver circuit is physically disconnected from the driver chip.

17. The method for repairing a display device according to claim 16, wherein the driver chip is arranged on a driver circuit board, and the driver circuit board is provided with a first output lead and a second output lead, and correspondingly, the first screen gate driver circuit is provided with a first signal receiving end, connected to the first output lead of the driver circuit board; and the second screen gate driver circuit is provided with a second signal receiving end, connected to the second output lead of the driver circuit board; and an on/off point is provided between an output end of the driver chip and each of the first output lead and the second output lead of the driver circuit board.

* * * * *